US011116262B2

(12) United States Patent
Shiraishi et al.

(10) Patent No.: US 11,116,262 B2
(45) Date of Patent: Sep. 14, 2021

(54) GARMENT

(71) Applicant: MIZUNO CORPORATION, Osaka (JP)

(72) Inventors: Atsushi Shiraishi, Osaka (JP); Junji Nakamitsu, Osaka (JP); Hiroki Sakurai, Osaka (JP); Masataka Kannoto, Osaka (JP); Takahiro Yoshimi, Osaka (JP)

(73) Assignee: Mizuno Corporation, Osaka (JP)

( * ) Notice: Subject to any disclaimer, the term of this patent is extended or adjusted under 35 U.S.C. 154(b) by 295 days.

(21) Appl. No.: 15/542,362

(22) PCT Filed: Dec. 3, 2015

(86) PCT No.: PCT/JP2015/083983

§ 371 (c)(1),
(2) Date: Jul. 7, 2017

(87) PCT Pub. No.: WO2016/111099

PCT Pub. Date: Jul. 14, 2016

(65) Prior Publication Data

US 2018/0271182 A1 Sep. 27, 2018

(30) Foreign Application Priority Data

Jan. 9, 2015 (JP) ..... JP2015-003601

(51) Int. Cl.
*D04H 1/4391* (2012.01)
*D04H 1/02* (2006.01)
(Continued)

(52) U.S. Cl.
CPC ..... *A41D 3/00* (2013.01); *A41D 31/00* (2013.01); *A41D 31/04* (2019.02); *D04H 1/02* (2013.01);
(Continued)

(58) Field of Classification Search
CPC .. D01D 5/20; D01D 5/22; D01D 5/24; D04H 1/4391; D04H 3/018; D04H 1/02;
(Continued)

(56) References Cited

U.S. PATENT DOCUMENTS 3,676,991 A * 7/1972 Fairfield ..... D01G 11/02 428/362
4,129,675 A * 12/1978 Scott ..... D04H 1/435 2/81
(Continued)

FOREIGN PATENT DOCUMENTS

CN 101166689 4/2008
EP 0 317 192 5/1989
(Continued)

OTHER PUBLICATIONS

Thermore TMK: The Most Versatile Insulation in the Market, accessed Jun. 26, 2019, from https://apparelmag.com/thermore-tmk-most-versatile-insulation-market (Year: 2008).*
(Continued)

*Primary Examiner* — Marla D McConnell
*Assistant Examiner* — Christine X Nisula
(74) *Attorney, Agent, or Firm* — Hamre, Schumann, Mueller & Larson, P.C.

(57) ABSTRACT

A garment includes a covering fabric; padding to be filled inside the covering fabric; and quilting stitches. The padding is constituted by polyester staple fibers including fibers having a circular outer peripheral cross section and has an open fiber structure. The fibers constituting the padding have an irregular diameter, and a smoothing agent is fixed to surfaces of the fibers. Thus, it is possible to provide a garment free from problems of uneven distribution of padding and having favorable water removability at the time of washing, quick dryability, and a favorable sliding property
(Continued)

between fibers. This garment is suitable as a garment for sports to be washed repeatedly. Further, since the garment can be worn in a puffy state even when wet, it dries quickly by the body heat.

9 Claims, 3 Drawing Sheets

(51) Int. Cl.

| | |
|---|---|
| ***D04H 1/435*** | (2012.01) |
| ***A41D 3/00*** | (2006.01) |
| ***A41D 31/00*** | (2019.01) |
| ***A41D 31/04*** | (2019.01) |
| ***D06M 15/53*** | (2006.01) |
| ***D06M 15/643*** | (2006.01) |
| *D06M 101/32* | (2006.01) |

(52) U.S. Cl.
CPC ..... *D04H 1/435* (2013.01); *D04H 1/43914* (2020.05); *D04H 1/43918* (2020.05); *D06M 15/53* (2013.01); *D06M 15/643* (2013.01); *A41D 2600/10* (2013.01); *A41D 2600/104* (2013.01); *D06M 2101/32* (2013.01); *D06M 2200/40* (2013.01); *D10B 2331/04* (2013.01); *D10B 2501/04* (2013.01)

(58) Field of Classification Search
CPC . D04H 1/06; D04H 1/50; D04H 1/435; Y10T 442/609; Y10T 442/615; Y10T 428/2976; Y10T 442/61; Y10T 428/2909; Y10T 428/2922; Y10T 442/627; Y10T 442/612; B32B 5/08; A41D 31/00; A41D 2600/104; A41D 2600/10; A41D 2200/20; A41D 3/02; A41D 3/00; D10B 2501/04; D10B 2505/08; B68G 1/00; B68G 2001/005; D04B 1/20; A47G 9/00; D06M 15/507; D01F 6/62; D01F 6/92
USPC ..... 428/101, 102, 43, 399; 442/335, 336, 442/338, 341, 353, 360
See application file for complete search history.

(56) References Cited

U.S. PATENT DOCUMENTS

| | | | | |
|---|---|---|---|---|
| 4,340,631 | A * | 7/1982 | Endo | D01D 5/20 428/359 |
| 4,801,644 | A | 1/1989 | Coogan | |
| 5,104,725 | A * | 4/1992 | Broaddus | D01D 5/24 428/357 |
| 5,298,321 | A | 3/1994 | Isoda et al. | |
| 2006/0183852 | A1 | 8/2006 | Liu et al. | |
| 2008/0193690 | A1 | 8/2008 | Molina et al. | |
| 2013/0177731 | A1 * | 7/2013 | Moriarty | B32B 27/12 428/74 |

FOREIGN PATENT DOCUMENTS

| | | | | |
|---|---|---|---|---|
| JP | 62-003242 | | 1/1987 | |
| JP | 62-109813 | | 5/1987 | |
| JP | 06-093513 | | 4/1994 | |
| JP | 6-134150 | | 5/1994 | |
| JP | 2003-213524 | | 7/2003 | |
| JP | 2004-323990 | | 11/2004 | |
| JP | 2005068571 | A * | 3/2005 | H01H 13/20 |
| JP | 2006-115987 | | 5/2006 | |
| JP | 2006-307364 | | 11/2006 | |
| JP | 2006-345920 | | 12/2006 | |
| JP | 2007211387 | A * | 8/2007 | |
| JP | 3973681 | | 9/2007 | |
| JP | 2008-303480 | | 12/2008 | |
| JP | 2011117093 | A * | 6/2011 | |
| JP | 4950072 | | 3/2012 | |
| JP | 2012-172276 | | 9/2012 | |
| JP | 2012-214951 | | 11/2012 | |
| JP | 2013-136858 | | 7/2013 | |
| JP | 2013136858 | A * | 7/2013 | |
| JP | 2014-192771 | | 10/2014 | |
| JP | 2014231660 | A * | 12/2014 | |
| KR | 1991-0008667 | | 10/1991 | |

OTHER PUBLICATIONS

Espacenet translation of JP-2014231660-A, accessed on Jun. 26, 2019. (Year: 2014).*
Espacenet translation of JP-2007211387-A, accessed on Jun. 26, 2019. (Year: 2007).*
Espacenet translation of JP-2011117093-A, accessed on Jun. 26, 2019. (Year: 2011).*
Espacenet translation of JP-2005068571-A, accessed on Jun. 26, 2019. (Year: 2005).*
Espacenet translation of JP-2013136858-A, accessed on Jun. 15, 2020. (Year: 2013).*
Office Action issued in corresponding Korean Patent Application No. 10-2017-7019194, dated Apr. 19, 2018, 6 pages.
Office Action issued in corresponding Chinese Patent Application No. 201580072734.3, dated Apr. 28, 2018, 5 pages.
Office Action of Japanese Application No. 2015-236349 dated Aug. 2, 2016, 3 pages. In Japanese only.
International Search Report issued for Application Serial No. PCT/JP2015/083983, dated Aug. 2, 2016, 5 pages. English translation.

* cited by examiner

GARMENT

TECHNICAL FIELD

The present invention relates to a garment filled with padding inside the covering fabric. More specifically, the present invention relates to a garment suitable for outdoor sports.

Background Art

Conventionally garments filled with down, synthetic fiber padding, etc., inside the covering fabric have been valued in the cold season. Patent Document 1 proposes the use of polyester fibers having loft, resiliency, and excellent thermal deformation resistance obtained by multi-stage drawing, as a vehicle cushioning material. Patent Document 2 proposes blowing opened staple fibers into a bag-like wrapping fabric together with pressurized air. Patent Document 3 proposes an artificial feather composed of untwisted fiber bundles and binding members. Patent Document 4 proposes blended wadding including fine staple fibers having a non-multilobal cross section, fine staple fibers having a multilobal cross section, and thick staple fibers.

PRIOR ART DOCUMENTS

Patent Documents

Patent Document 1: JP 1994(H6)-093513 A
Patent Document 2: JP 2006-307364A
Patent Document 3: JP 3973681
Patent Document 4: JP 2012-214951 A

DISCLOSURE OF INVENTION

Problem to be Solved by the Invention

However, the above conventional garments filled with down adhere to a body and drop the body temperature when get wet with sweat, rain, snow, etc., and they are not washable. Moreover, the above conventional garments filled with padding such as synthetic fibers have problems of heavy weight, poor texture, uneven distribution of padding after repeated washing, fatigue, poor water removability at the time of washing, and poor dryability.

In order to solve the above conventional problems, the present invention provides a garment free from such problems of uneven distribution of padding after repeated washing, fatigue, etc., and having favorable water removability at the time of washing, quick dryability, and a favorable sliding property between fibers of the padding even though synthetic fiber cotton is used as the padding.

Means for Solving Problem

A garment of the present invention is a garment that includes: a covering fabric; padding to be filled inside the covering fabric; and quilting stitches. The padding is a polyester staple fiber cotton including fibers having a circular outer peripheral cross section, and has an open fiber structure. The fibers constituting the padding have an irregular diameter, and a smoothing agent is fixed to surfaces of the fibers.

Effect of the Invention

In the present invention, single fibers constituting the padding have an irregular diameter (thickness variation), and the padding has an open fiber structure. Thereby, it is possible to provide a garment having a favorable sliding property between fibers, and free from the problems of the uneven distribution of the padding after repeated washing, fatigue, etc., and having favorable water removability at the time of washing and quick dryability. The garment of the present invention is suitable as a garment for sports to be washed repeatedly. Further, since the garment can be worn in a puffy state even when gets wet with sweat, rain, snow, water, etc., it dries quickly by the body temperature and prevents the coldness of the body.

DESCRIPTION OF THE INVENTION

Figure 1:
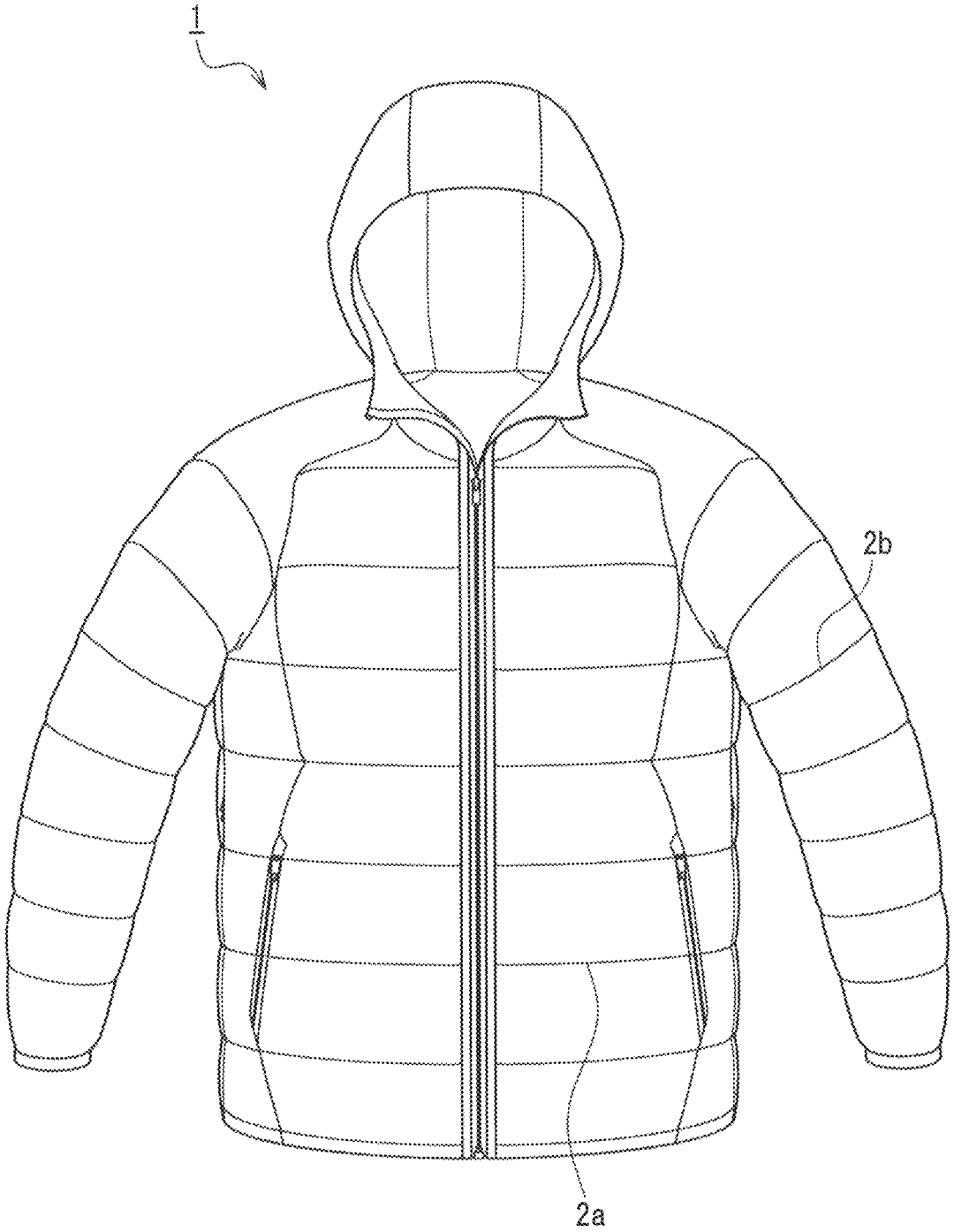
FIG. 1 is a schematic front view of a garment in an example of the present invention.

The present invention is suitable as a padding garment for sports such as skiing, running, walking, cycling, climbing, and tennis in the cold season. This garment includes padding inside the covering fabric, and quilting stitches. The quilting stitches make the padding less movable, thereby preventing the uneven distribution of the padding during washing. Moreover, the garment has high functionality as a garment for sports, and thus hardly hinders the movements of a body.

As the padding, fibers having a circular outer peripheral cross section are used. Preferably, hollow polyester staple fiber cotton including fibers having a circular outer peripheral cross section is used. When having a circular outer peripheral cross section, fibers can have superior water removability. Hollow polyester cotton has been conventionally used because it traps air and gives warmth. A smoothing agent is applied to the surface of the padding. By coating with a smoothing agent, a sliding property between fibers increases. Examples of the smoothing agent include silicone compounds such as polyorganosiloxane, and surfactants such as polyaxyethylene alkyl ethers. Preferably, the smoothing agent is fixed to the surfaces of the fibers, and has washing resistance. The amount of the smoothing agent fixed to the fibers is preferably 0.05 to 5 mass %, more preferably 0.1 to 3 mass %, and further preferably 0.3 to 2 mass %.

The fibers of the padding having a circular outer peripheral cross section are not mutually bonded by a binder, fusible fibers, etc., or not molded into a sheet. The padding is in a state of opened cotton typified by a carded web. This state is called an "open fiber structure". In the case of using a binder, generally a binder containing an organic solvent is applied to the surfaces of the fibers to bond them chemically. In the case of using fusible fibers, the fusible fibers are melted thermally, and an area where fibers are in contact with the fusible fibers are bonded mutually when cooled. The padding of the present invention contains neither a binder nor fusible fibers.

Each of the fibers (single fiber) constituting the padding of the present invention has an irregular diameter. Such fibers can reduce friction between fibers because they approximately make point contact with each other. A synergistic effect that is obtained by the reduced friction by the irregular diameters of the single fibers and the improved sliding property by the smoothing agent that is fixed to the surfaces of the fibers enables production of a garment free from the problems of uneven distribution of the padding after repeated washing, fatigue, etc., and having favorable water removability at the time of washing and quick dryability.

This garment is suitable as a garment for sports to be washed repeatedly. Further, since the garment can be puffy even when wet with sweat, rain, snow, etc., it dries quickly by the body temperature and prevents the coldness of the body. Moreover, since the fibers are less likely to fatigue, they can trap air and retain the warmth. A difference between a maximum diameter and a minimum diameter of the irregular diameter in each of the constituent fibers is preferably 2 to 20 μm, more preferably 3 to 18 μm, and further preferably 3 to 15 μm, based on the observation of the side face of the fiber. When the difference between the maximum diameter and the minimum diameter in the single fiber is less than 2 μm, a contact area between fibers becomes large, which increases friction between the fibers and entangles them by washing, resulting in a tendency of uneven distribution. When the difference exceeds 20 μm, asperities on the surfaces of the fibers increase and the fibers get caught by the asperities, which entangles the fibers by washing and results in a tendency of uneven distribution. The irregular diameter was observed with a digital microscope, and the fiber diameters measured are shown by data. The padding of the present invention is not limited particularly as long as it partially includes the fibers having an irregular diameter. The amount of the fibers having an irregular diameter included in the padding is preferably 10 mass % or more, more preferably 40 mass % or more, and further preferably 60 mass % or more.

An area surrounded by the quilting stitches is preferably 3 to 800 $cm^2$ more preferably 4 to 600 $cm^2$. Within this range, the washing resistance is enhanced further. If the area is 3 $cm^2$ or more, the loft will not collapse by the quilting stitches, and a product with a satisfactory puff feeling can be obtained. The filling amount of the padding per unit area is preferably 50 to 500 $g/m^2$, more preferably 80 to 400 $g/m^2$. The filling amount of the padding exceeding 500 $g/m^2$ will make the garment heavy as a product and limits the movement of cotton within a quilt, which deteriorates the comfortableness. The filling amount of the padding of less than 50 $g/m^2$ will result in the uneven distribution of cotton by washing, and the change of appearance.

The fineness of the fiber cotton having a circular outer peripheral fiber cross section is preferably 1.1 to 5.5 dtex, more preferably 1.5 to 5.0 dtex. The fiber length is preferably 10 to 100 mm, more preferably 15 to 80 mm. The hollow rate is preferably 10 to 50%, more preferably 15 to 40%. Within the above ranges, basic properties of the padding including warmth and loft can be high.

The number of crimps of the fiber cotton having a circular outer peripheral fiber cross section is preferably 2 to 9/2.5 cm, more preferably 3 to 8/2.5 cm. Within the above range, basic properties of the padding including warmth and loft can be high, and the fatigue of the padding is less likely to occur. When the crimp change rate is 25% or less, the decrease in the loft by washing and the uneven distribution can be reduced, and the heat retaining property can be maintained.

In the present invention, the padding is filled inside the covering fabric, and quilting stitches are used to fix at least part of the padding to the covering fabric. Thereby, the movement of the padding is stopped and the washing resistance is improved. When a nonwoven fabric is disposed inside the covering fabric and the padding is filled therein, a friction resistance caused by contact between the padding and the nonwoven fabric becomes larger than a friction resistance caused by contact between the padding and the covering fabric, thereby avoiding the uneven distribution by washing. The nonwoven fabric is preferably 40 $g/m^2$ or less. The nonwoven fabric exceeding 40 $g/m^2$ will make a product hard with stiffness and tension, and the movement of a wearer is hindered. The composition and the molding method of the nonwoven fabric, the presence or absence of resin, and the type of resin are not limited.

Figure 2:
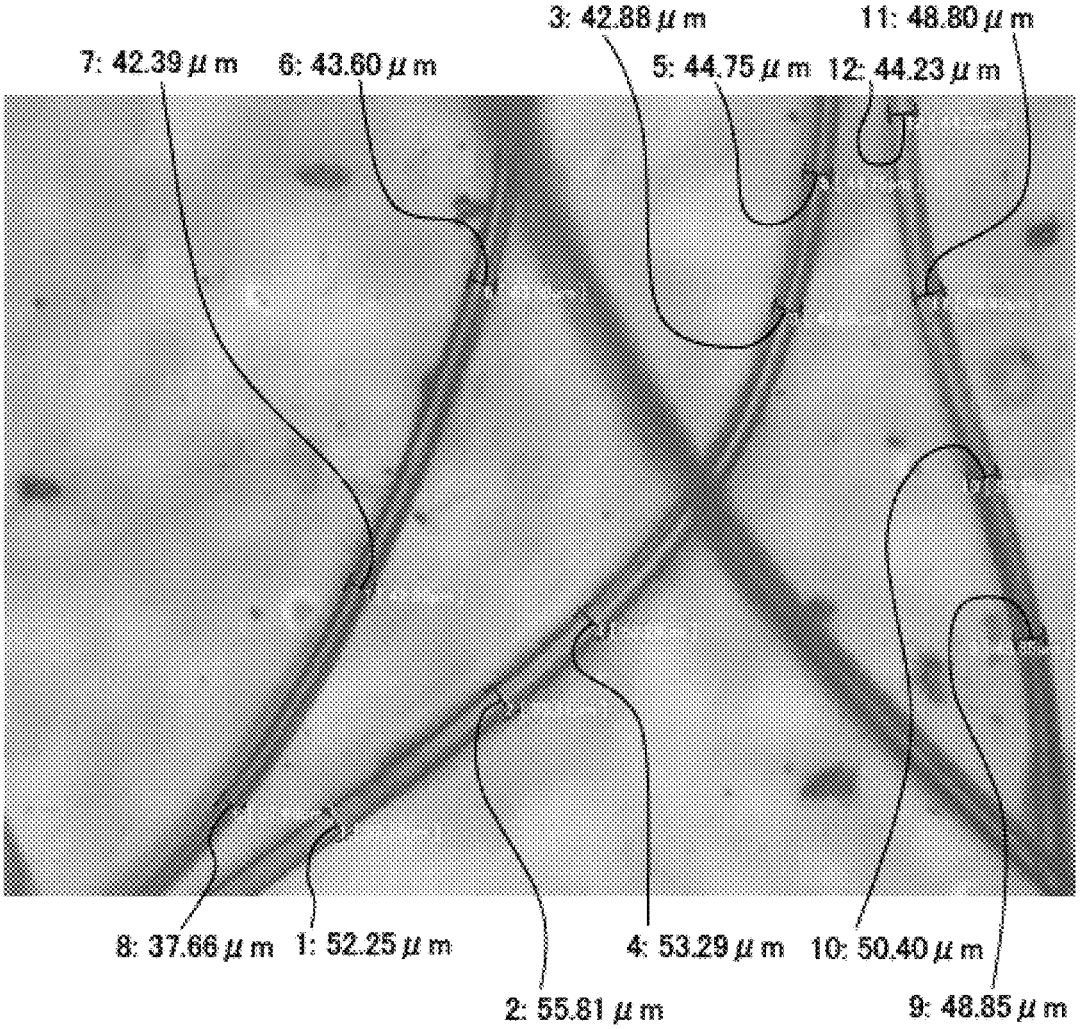
FIG. 2 is an observation photograph of fibers to be filled in the garment (taken by a digital microscope at 500× magnification)

Hereinafer, the present invention will be described with reference to the drawings. FIG. 1 is a schematic front view of a garment in an example of the present invention. A garment 1 is an exemplary hooded blouson with a plurality of quilting stitches 2*a*, 2*b*. FIG. 2 is an observation photograph of fibers constituting the padding to be filed in the garment. The detailed explanation will be given in the following examples.

EXAMPLES

Hereinafter, the present invention will be specifically described by way of examples. However, the present invention is not limited to the examples.

<Uneven Distribution Rate by Washing>

Each sample was washed in accordance with JIS L0217 103, and the uneven distribution of cotton of the sample directly after dewatering was checked. A portion of the quilt with the largest uneven distribution in the sample was measured. The uneven distribution rate by washing was determined by the following formula.

$$\text{Uneven distribution rate by washing (\%)} = A/B \times 100$$

A: An area of a portion in the quilt where the cotton was unevenly distributed and significantly thin directly after dewatering B: An area of the quilt used in A <Evaluation of Dewatering Rate>

The weight of the sample before washing was measured (weight: C). The uneven distribution of cotton of the sample directly after dewatering was checked, and the weight at that time was measured (weight: D). The dewatering rate was determined by the following formula.

$$\text{Dewatering rate (\%)} = D/C \times 100$$

<Evaluation of Heat Retaining Property>

The heat retaining property was evaluated with KES (THERMOLABO II: Precise and Fast Thermal Property-Measuring Instrument) ($\Delta T = 20°$ C.).

<Sensory Evaluation>

Sensory evaluation was conducted by 20 males to examine the puff feeling of each sample by touch and the appearance of each sample after washing. The following are evaluation criteria.

1 point: Very poor
2 points: Poor
3 points: Normal
4 points: Good
5 points: Very good <Evaluation of Crimp Rate>

The crimp rate of each sample was evaluated in accordance with JIS L 1015 (Test methods for man-made staple fibers), and determined by the following formula.

$$\text{Crimp change rate} = (F-E)/E \times 100$$

E: The number of crimps before filling (number/2.5 cm)
F: The number of crimps after filling (number/2.5 cm)

Examples 1-8

As the padding, hollow staple fiber cotton made of polyethylene terephthalate (the average fineness: 3.3 dtex, the fiber length: 38 mm, the cross section: round, the hollow rate: 20%, the number of crimps 5/25.4 mm) was used. The padding was opened cotton, and 1 mass % of a fiber treatment (smoothing agent) containing a polyorganosiloxane-based silicone compound and polyoxyethylene alkyl ether was applied and fixed to the surface. FIG. 2 is an observation photograph of the fibers. The irregular diameters of the fibers are indicated in Table 1. FIG. 2 is an observation photograph taken by a digital microscope manufactured by KEYENCE CORPORATION (500× magnification). The following is the measurement method using the digital microscope.

Device: VHX Digital Microscope, VHX-200

Lens: VH-Z100

<Method of Measuring Distance Between Two Points on Screen of Microscope>

Select the magnification of the lens from the lens button in the status bar

Select measurement from the menu bar

Select the two-point bottom in the measurement tool and click a starting point of the two points to be measured Click an end point and read the indicated distance The distance from the starting point to the end point is a distance from an outermost periphery to another outermost periphery of the fiber.

TABLE 1

| | Irregular fiber diameter (thickness variation) | | | | | Difference between maximum diameter and minimum diameter (μm) |
|---|---|---|---|---|---|---|
| | Diameter (μm) | Diameter (μm) | Diameter (μm) | Diameter (μm) | Diameter (μm) | |
| Fiber A | (1) 52.25 | (2) 55.81 | (3) 42.88 | (4) 53.29 | (5) 44.23 | 12.93 |
| Fiber B | (6) 43.60 | (7) 42.39 | (8) 37.66 | — | — | 5.94 |
| Fiber C | (9) 48.85 | (10) 50.40 | (11) 48.80 | (12) 44.23 | — | 6.17 |

(Remarks) The numbers in parentheses indicated before diameters correspond to the numbers in FIG. 2 (observed portions).

Padding including uniformly mixed fibers A to C (Table 1) was used. As the covering fabric (a front fabric and a back fabric), a plain-woven fabric (weight per unit area: 32 g/m$^2$) having a warp density of 262 yarns/25.4 mm and a weft density of 148 yarns/25.4 mm was prepared using polyester (PET) multifilament processed yarns (fineness: 22 dtex), and stitched to have a quilt area indicated in Table 2. Table 2 also indicates the test results. In Table 2, Example 2 is an example in which a spunbonded nonwoven fabric (weight per unit area: 20 g/m$^2$) was placed inside the covering fabric and sewn together.

Comparative Example 1

A sample of Comparative Example 1 was tested in the same manner as in Example 1 except that granular cotton on the market was used as filling.

Comparative Example 2

A sample of Comparative Example 2 was tested in the same manner as in Example 1 except that down on the market was used as filling.

Comparative Example 3

A sample of Comparative Example 3 was tested in the same manner as in Example 1 except that resin cotton on the market was used as filling.

Comparative Example 4

A sample of Comparative Example 4 was tested in the same manner as in Example 1 except that polyester (PET) cotton on the market having a crimp change rate of 30% was used as filling. This marketed cotton was open staple fiber cotton, and the diameter of single fibers constituting the cotton was uniform.

TABLE 2

| | Filling amount (g/m$^2$) | Area of quilt (cm$^2$) | Crimp change rate (%) | Type of padding | Nonwoven fabric | Uneven distribution rate by washing (%) | Dewatering rate (%) | Heat retaining property (Clo value) | Sensory Test Puff feeling | Sensory Test Change of appearance by washing |
|---|---|---|---|---|---|---|---|---|---|---|
| Ex. 1 | 80 | 600 | 25 | Product of Ex. 1 | Absent | 15 | 23 | 2.00 | 4.2 | 4.1 |
| Ex. 2 | 80 | 600 | 25 | Product of Ex. 2 | Present | 12 | 23 | 2.02 | 4.7 | 4.7 |
| Ex. 3 | 100 | 400 | 25 | Product of Ex. 3 | Absent | 10 | 24 | 2.03 | 4.8 | 4.9 |

TABLE 2-continued

| | Filling amount ($g/m^2$) | Area of quilt ($cm^2$) | Crimp change rate (%) | Type of padding | Nonwoven fabric | Uneven distribution rate by washing (%) | Dewatering rate (%) | Heat retaining property (Clo value) | Sensory Test Puff feeling | Sensory Test Change of appearance by washing |
|---|---|---|---|---|---|---|---|---|---|---|
| Ex. 4 | 120 | 400 | 25 | Product of Ex. 4 | Absent | 4 | 23 | 2.05 | 5.0 | 5.0 |
| Ex. 5 | 140 | 400 | 25 | Product of Ex. 5 | Absent | 0 | 25 | 2.06 | 5.0 | 5.0 |
| Ex. 6 | 160 | 400 | 25 | Product of Ex. 6 | Absent | 0 | 24 | 2.07 | 5.0 | 5.0 |
| Ex. 7 | 180 | 400 | 25 | Product of Ex. 7 | Absent | 0 | 23 | 2.07 | 5.0 | 5.0 |
| Ex. 8 | 200 | 400 | 25 | Product of Ex. 8 | Absent | 0 | 25 | 2.07 | 5.0 | 5.0 |
| Comp. Ex. 1 | 80 | 600 | — | Granular cotton | Absent | 30 | 29 | 1.79 | 1.8 | 1.5 |
| Comp. Ex. 2 | 80 | 600 | — | Down | Absent | 0 | 49 | 1.98 | 4.2 | 5.0 |
| Comp. Ex. 3 | 80 | 600 | — | Resin cotton | Absent | 0 | 25 | 1.79 | 1.2 | 5.0 |
| Comp. Ex. 4 | 80 | 600 | 30 | Marketed padding | Absent | 20 | 29 | 1.99 | 3.9 | 2.9 |

* Ex.: Example, Comp. Ex.: Comparative Example

As is clear from Table 2, the samples of Examples 1-8 were excellent in the puff feeling, the dewatering rate, the heat retaining property, and the sensory test, and had little uneven distribution of padding by washing.

Figure 3:
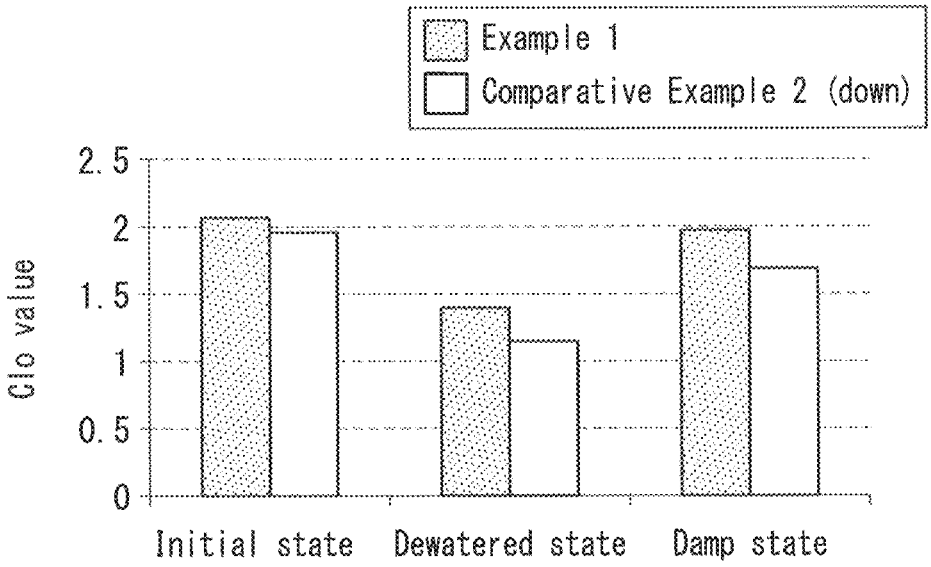
FIG. 3 is a graph showing the result of a comparative experiment on heat retaining property using a garment of an example of the present invention and a garment of Comparative Example 2 (down).

Next, the heat retaining property was compared. In this experiment, garments in the shape of FIG. 1 were prepared using the sample of Example 1 and the sample of Comparative Example 2 (down), and they were each put on a thermal manikin (manufactured by Kyoto Electronics Manufacturing Co., Ltd.). The surface temperature of the manikin was set at 40° C., and a consumed power at that time was measured to determine a Clo value. The temperature of the measurement environment was 20° C. (room temperature), and the relative humidity was 65% RH. Clo values of the garments in an initial state, a state after washing and dewatering, and a damp state were measured in this order. The results are shown in FIG. 3 (graph). The dewatered state is assumed to be a state of a garment entirely wet with rain. The damp state is assumed to be a state of a garment entirely damped with sweat. A comfortable temperature range is f 0.5° C. of a general PMV (Predicted Mean Vote). The temperature of the garment of Example 1 in the initial state was different from the comfortable temperature range by 1.1° C., the temperature in the dewatered state was different therefrom by 4.5° C., and the temperature in the damp state was different therefrom by 2.4° C.

From the above, the garment of Example 1 maintained its heat retaining property even after washing. This shows that the garment of Example 1 has a superior heat retaining property than the garment of Comparative Example 2 (down) when wet with water and sweat. Therefore, the garment of Example 1 is resistant to bad weather, and suitable also for strenuous sports.

Figure 4:
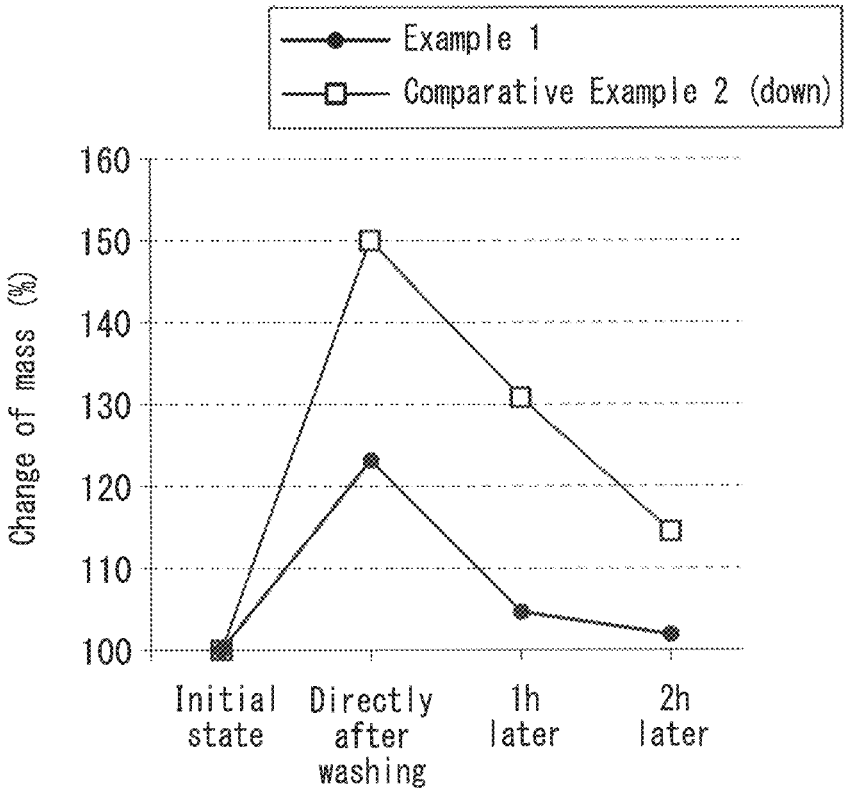
FIG. 4 is a graph showing the result of a comparative experiment on drying speed after washing using the garment of an example of the present invention and the garment of Comparative Example 2 (down).

Next, the drying speed was compared using the garment of Example 1 and the garment of Comparative Example 2 (down) shown in FIG. 1. FIG. 4 shows the change of mass of the garments from an initial state, to a state directly after washing, a state one hour after washing, and a state two hours after washing. As is clear from FIG. 4, the moisture content of the garment of Example 1 directly after washing was low, and the drying speed was fast. This shows that the garment of Example 1 has high water removability and dries fast even when gets wet with rain, thereby requiring little care or maintenance, and preventing the body temperature from dropping even when wet.

INDUSTRIAL APPLICABILITY

The garment of the present invention is suitable as a padding garment for sports including skiing, running, walking, cycling, climbing, and tennis, and also suitable as work clothing and general cold protection clothing.

DESCRIPTION OF REFERENCE NUMERALS

1 garment
2*a*, 2*b* quilting stitch

The invention claimed is:

1. A garment comprising:
a covering fabric;
padding to be filled inside the covering fabric; and
quilting stitches,
wherein the padding is constituted by a plurality of polyester staple fibers having a circular outer peripheral cross section and the padding has an open fiber structure,
each single fiber of the plurality of polyester staple fibers constituting the padding has an irregular diameter, with a difference between a maximum diameter and a minimum diameter of the irregular diameter in each of the polyester staple fibers being 2 μm to 20 μm based on an observation of a side face of each of the polyester staple fibers, and a smoothing agent is fixed to surfaces of each of the plurality of polyester staple fibers that imparts to the polyester staple fibers an increased sliding property between fibers relative to the sliding property between fibers of the polyester staple fibers without the smoothing agent,
the polyester staple fibers have a fineness of 1.1 dtex to 5.5 dtex and a length of 20 mm to 120 mm, and have a crimp change rate of 25% or less determined in accordance with JIS L 1015 (Test methods for man-made staple fibers) by the following formula:
crimp change rate $=(F-E)/E\times100$,
where E represents the number of crimps before filling (number/2.5 cm), and F represents the number of crimps after filling (number/2.5 cm), and
a dewatering rate of the garment determined by the following formula is 24% or less:
dewatering rate (%) $=D/C\times100$,
where C represents a weight of the garment before washing, and D represents a weight of the garment directly after dewatering.

2. The garment according to claim 1, wherein an area surrounded by the quilting stitches is 3 $cm^2$ to 800 $cm^2$.

3. The garment according to claim 1, wherein a filling amount of the padding per unit area is 50 $g/m^2$ to 500 $g/m^2$.

4. The garment according to claim 1, wherein the polyester staple fibers are hollow.

5. The garment according to claim 4, wherein a number of crimps of the hollow polyester staple fibers is 2 to 9/2.5 cm.

6. The garment according to claim 1, wherein at least part of the padding is fixed to the covering fabric by the quilting stitches.

7. The garment according to claim 4, wherein the polyester staple fibers have a hollow rate of 10% to 50%.

8. The garment according to claim 1, further comprising a nonwoven fabric disposed inside the covering fabric together with the padding.

9. The garment according to claim 1, wherein the garment has a Clo value (heat retaining property) of 2.00 or more.

* * * * *